US009859636B2

(12) United States Patent
Boyd et al.

(10) Patent No.: US 9,859,636 B2
(45) Date of Patent: Jan. 2, 2018

(54) LINEAR EDGE CONNECTOR WITH ACTIVATOR BAR AND CONTACT LOAD SPRING

(71) Applicant: INTEL CORPORATION, Santa Clara, CA (US)

(72) Inventors: Thomas A. Boyd, North Plains, OR (US); Jeffory L. Smalley, East Olympia, WA (US); Russell S. Aoki, Tacoma, WA (US); Karumbu Meyyappan, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 54 days.

(21) Appl. No.: 14/757,915

(22) Filed: Dec. 24, 2015

(65) Prior Publication Data

US 2017/0187134 A1 Jun. 29, 2017

(51) Int. Cl.
*H01R 12/72* (2011.01)
*H01R 12/70* (2011.01)
(Continued)

(52) U.S. Cl.
CPC ..... *H01R 12/721* (2013.01); *H01R 12/7005* (2013.01); *H01R 13/631* (2013.01);
(Continued)

(58) Field of Classification Search
CPC ..... H01R 12/721; H01R 12/7005
(Continued)

(56) References Cited

U.S. PATENT DOCUMENTS 3,710,303 A * 1/1973 Gallager, Jr. ..... H01R 12/87 439/108
7,666,015 B2 * 2/2010 Sakamoto ..... H01R 13/629 439/260

(Continued)

FOREIGN PATENT DOCUMENTS

JP 2015185210 A 10/2015

OTHER PUBLICATIONS

PCT International Search Report, PCT Application No. PCT/US2016/056993, dated Jan. 10, 2017, 3 pages.

(Continued)

*Primary Examiner* — Tulsidas C Patel
*Assistant Examiner* — Marcus Harcum
(74) *Attorney, Agent, or Firm* — International IP Law Group, P.L.L.C.

(57) ABSTRACT

An example apparatus for connecting linear edge cards includes a housing to hold at least one set of conductive contacts facing perpendicularly towards a mating plane. The apparatus further includes an activator bar coupled to the housing, the activator bar to hold two parts of the housing apart via two opposing normal forces. The apparatus also includes a contact load spring coupled to the housing, the contact load spring to apply two forces parallel to the direction of the conductive contacts and against the two opposing normal forces of the activator bar. The apparatus further includes an ejector spring coupled to the contact load spring and the activator bar. The ejector spring is to apply a force perpendicular to the two opposing normal forces of the activator bar and in a direction of an opening of the housing.

19 Claims, 6 Drawing Sheets

200

300

(51) Int. Cl.

| | |
|---|---|
| ***H01R 13/631*** | (2006.01) |
| ***H01R 13/635*** | (2006.01) |
| ***H01R 13/648*** | (2006.01) |
| ***H01R 43/26*** | (2006.01) |

(52) U.S. Cl.
CPC ..... *H01R 13/635* (2013.01); *H01R 13/6485* (2013.01); *H01R 43/26* (2013.01)

(58) Field of Classification Search
USPC ..... 439/155, 159, 160, 325, 327, 328
See application file for complete search history.

(56) References Cited

U.S. PATENT DOCUMENTS

| | | | | |
|---|---|---|---|---|
| 8,398,423 | B2 * | 3/2013 | Simmel | H01R 12/721 439/346 |
| 2005/0014405 | A1 | 1/2005 | Chen | |
| 2006/0223375 | A1 | 10/2006 | Chang et al. | |
| 2007/0149005 | A1 | 6/2007 | Togami et al. | |
| 2011/0300749 | A1 | 12/2011 | Sytsma et al. | |
| 2012/0122331 | A1 * | 5/2012 | Cheng | H01R 13/639 439/327 |
| 2013/0084723 | A1 * | 4/2013 | Shen | H01R 12/7029 439/159 |
| 2015/0280337 | A1 | 10/2015 | Chawla et al. | |

OTHER PUBLICATIONS

Tran et al., U.S. Appl. No. 14/757,626, filed Dec. 23, 2015, US Application, Drawings, and Filing Receipt dated Jan. 29, 2016 attached (70 pages), not yet published.

* cited by examiner

100

200

300

400

500

LINEAR EDGE CONNECTOR WITH ACTIVATOR BAR AND CONTACT LOAD SPRING

TECHNICAL FIELD

The present techniques relate generally to a linear edge connector, and more particularly, to a linear edge connector with an activator bar and contact load spring.

BACKGROUND ART

Linear edge connectors (LECs) are used to connect circuit boards such as processors, memory, and peripheral cards to computing devices. For example, peripherals can include audio and video cards, among other peripheral cards.

BRIEF DESCRIPTION OF DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

Figure 1:
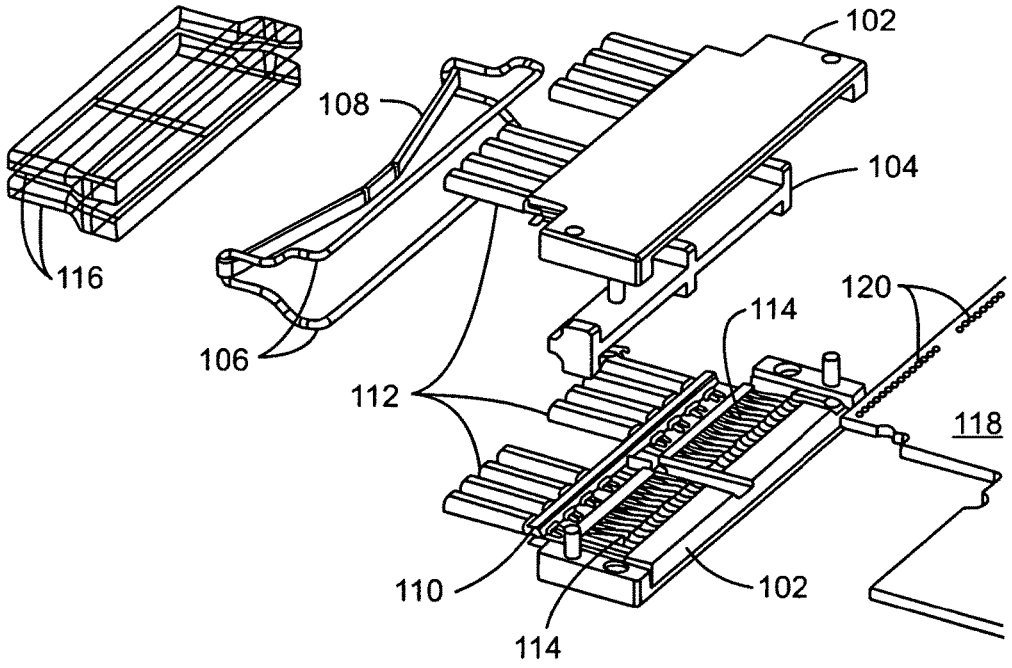
FIG. 1 is an exploded view of an example linear edge connector.

As described above, linear edge connectors (LECs) are used to connect substrates to computing devices. However, existing LECs have various issues. For example, current LECs rely on an external structure to retain the card edge to the connector. In addition, present LECs limit substrates to a single board thickness because the connector body and contacts are optimized for the single board thickness. Moreover, current LECs have an inherent risk of abrading when riding against the substrate solder mask surface during engagement. This abrasion can eventually result in loss of conductive gold plating and high contact resistance or open circuits. Furthermore, contacts using current LECs include extra features to accommodate the sliding mate cycle that create signal integrity issues for higher signaling speeds.

The present techniques relate generally to a linear edge connector. Embodiments relate to a linear edge connector with an activator bar to receive and guide a circuit board and a contact load spring to provide force to mate pads of the circuit board with contacts of the linear edge connector housing. A circuit board, as used herein, refers to any substrate including conductive pads and circuitry, such as a processor substrate among other substrates. The embodiments enable a circuit board to be received without any friction against the contacts during insertion. Thus, the present techniques prevent wearing of the pads on the circuit board. Furthermore, contamination risk is reduced because the housing contacts do not wipe across any circuit board edge. In addition, the techniques enable a wider range of circuit board thicknesses of to be used. For example, the contact load spring may provide about the same force for mating the contacts regardless of the thickness of the circuit board. In some embodiments, the housing further includes internal structures to retain the housing to the circuit board. Thus, techniques can be used to improve stability of the connector to the substrate to reduce fretting and other vibration associated failures of circuit board connections. The present techniques also have minimal platform impact as they are independent of heat sink enabling hardware. For example, previous LEC designs use a wire bale that interfaces with a bolster plate that is attached to the motherboard. The present techniques do not rely on any such wire bale, or other heat sink enabling hardware, and thus have minimal platform impact. Finally, the present techniques enable contacts to be designed without any lead-ins that can potentially cause poor signal integrity. For example, contact geometry can be modified to remove the lead-ins. Thus, improved contact designs can be used with the present techniques for high speed signaling to reduce signal noise in high speed implementations, such as 10 Gbps and higher. Moreover, less pad length is needed since the contacts do not slide, and the features of the LEC will more accurately locate the contacts of the LEC to the pads. Finally, use experience may be improved via the ease of installation and removal afforded by the improved LEC design.

FIG. 1 is a diagram of an example linear edge connector. The example linear edge connector is generally referred to by the reference number 100.

In the example linear edge connector (LEC) 100, a housing 102 includes two parts that enclose an activator bar 104. As used herein, an activator bar can refer to any sliding nonconductive element that can be used to hold the housing open and close the housing when interacting with a ramp or similar mechanism. For example, activator bar can include a cam that can engage one or more ramps. The housing 102 and the activator bar 104 can be made of any suitable nonconductive material, such as plastic. The housing 102 is coupled to a contact load spring 106. A contact load spring 106, as used herein, refers to any element that can apply force between the contact tips and the circuit board pad. For example, the contact load spring 106 can make the elements of the housing 102 active in a clamshell or clothespin like manner. In some examples, the contact load spring 106 can be made of any suitable material with elasticity, such as metal alloy. The contact load spring 106 is coupled to an ejector spring 108. For example, the ejector spring can also be made of any suitable material with elasticity, such as a metal alloy. Each side of the housing 102 includes a ground bar 110. For example, the ground bar 110 can be made of any suitable conductive material, such as copper among other metals. The ground bar 110 can be used to provide grounding for electric cables. The housing 102 is further coupled to a plurality of cables 112. For example, the cables can be twinaxial cables. The cables can also be made of any suitable conductive material, such as copper, silver, or gold, among other conductive materials. Each side of the housing 102 further includes a plurality of contacts 114. For example, the plurality of contacts can be made of any suitable material that is both conductive and resistant to corrosion. In some examples, two sets of conductive contacts 114 can be held facing perpendicular towards a mating plane and in opposing directions. The plurality of contacts 114 are coupled to the plurality of cables 112. Each set of cables 112 is enclosed in an over-molding 116. For example, the over-molding can be any nonconductive material, such as plastic, that can be used to protect contents from corrosion and contamination.

Furthermore, a circuit board 118 is depicted. The circuit board is positioned parallel to the mating plane. The circuit board 118 includes a plurality of pads 120. For example, the pads 120 can be made of any suitable material that is both conductive and resistant to corrosion. In some examples, the circuit board 118 can be a graphics processing unit (GPU), central processing unit (CPU), memory module, network interface card (NIC), among other devices as described with respect to FIG. 6 below. The circuit board 118 can be coupled to a computing system via the example linear edge connection 100 according to techniques described herein.

In FIG. 1, the circuit board 118 can be coupled to a computing device (not shown) via the example LEC 100. The circuit board 118 can be inserted into the LEC 100 via a guidance of the activator bar 104 without any friction between the pads 120 of the circuit board 118 and the contacts 114 of the LEC. Thus, pad 120 and/or contact 114 wear due to friction in continuous contact insertion is avoided. Moreover, when the LEC 100 is fully engaged, the contact load spring 106 applies a continuous force to mate the pads 120 of the circuit board to the contacts 114 of the LEC 100. This design enables different thicknesses of circuit board 118 to be used and received by the LEC 100. Thus, circuit boards 118 with a variety of layers and therefore thicknesses can be used with the same example LEC 100. The functionality of the example LEC 100 is explained in greater detail with respect to FIGS. 2-4 below.

The diagram of FIG. 1 is not intended to indicate that the example LEC 100 is to include all of the components shown in FIG. 1. Further, the example LEC 100 may include any number of additional components not shown in FIG. 1, depending on the details of the specific implementation. For example, the example LEC 100 may include additional cables, contacts, springs, among other additional components. For example, the ejector spring 108 can be replaced with any suitable mechanism to apply force to the activator bar. Likewise, the contact load spring can be replaced with any suitable mechanism for applying a force to apply force between the contact tips and the circuit board pads.

Figure 2:
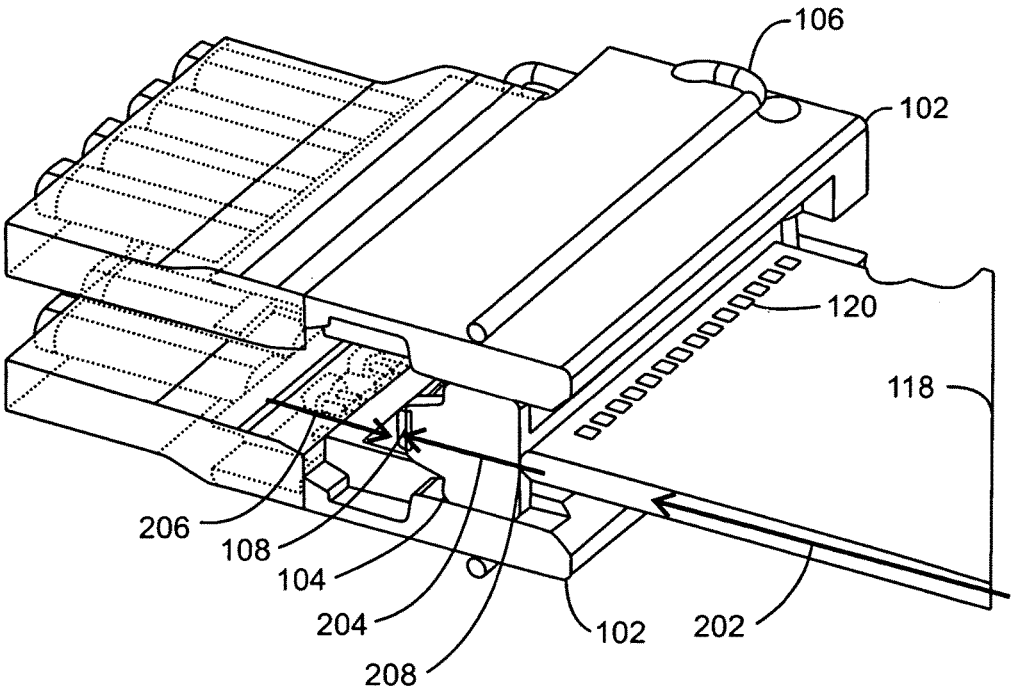
FIG. 2 is an angled view of an example linear edge connector to receive a circuit board.

FIG. 2 is an angled view of an example linear edge connector to receive a circuit board. The example linear edge connector is generally referred to by the reference number 200.

The example linear edge connector 200 includes an activator bar 104 coupled to the housing 102. The housing 102 is held together via the contact load spring 106. A circuit board 118 with pads 120 is shown being inserted as indicated by an arrow 202. A second arrow 204 indicates the force from the circuit board insertion 202 being transferred to the activator bar 104. A third arrow 206 indicates a force from the ejector spring 108 opposing the force 204 originating from the insertion.

In the example of FIG. 2, the activator bar 104 is shown being held in an extended position by the ejector spring 108. Moreover, features in the activator bar 104 are shown holding the two halves of the housing 102 open and under the spring force of the contact load spring 106. The circuit board 118 is being inserted into the example LEC 200, but has not fully engaged the example LEC 200. The force 202 from the insertion causes a force 204 on the activator bar 104. When the force 204 at the activator bar is greater than the force at the ejector spring 108, the activator bar 104 and the circuit board 118 slide into the housing 102 of the example LEC 100. As shown in FIG. 2, in some examples, the circuit board 118 can be guided into the example LEC 200 via a recess 208 in the activator bar 104. In addition, a recess on the contact housings (not shown) can also help guide the circuit board 118 into position for insertion. A lead-in, as used herein, refers to a recessed, angled, or chamfered surface of the contact housing used to guide a circuit board towards the activator bar.

The angled view of FIG. 2 is not intended to indicate that the example linear edge connector 200 is to include all of the components shown in FIG. 2. Further, the example linear edge connector 200 may include any number of additional components not shown in FIG. 2, depending on the details of the specific implementation. For example, the example LEC 200 may include additional cables, contacts, springs, among other additional components.

Figure 3:
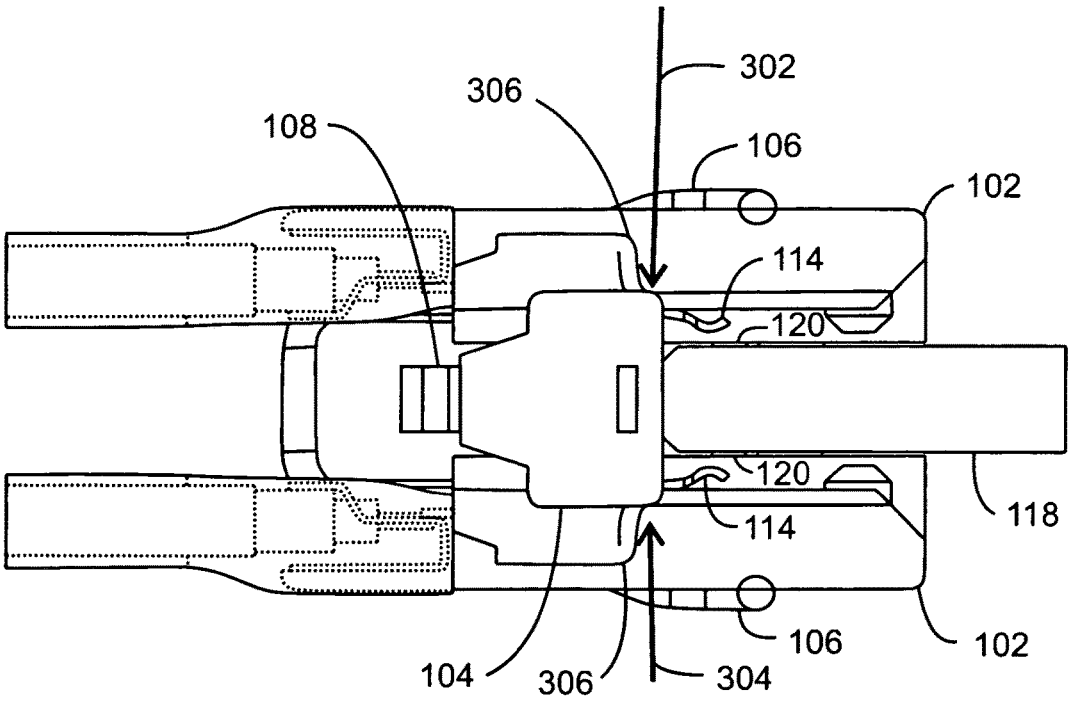
FIG. 3 is a side view of an example linear edge connector with a circuit board partially coupled.

FIG. 3 is a side view of an example linear edge connector with a circuit board partially coupled. The example linear edge connector of FIG. 3 is generally referred to by the reference number 300.

In FIG. 3, the open travel portion of the mating cycle of the circuit board 118 with the example linear edge connector 400 has completed. The side view of example linear edge connector 300 shows two sides of the contact load spring 106 providing two forces perpendicular to a circuit board 118 as shown by arrows 302 and 304. The contacts 114 of the housing 102 are shown not touching the pads 120 of the circuit board 118. In addition, the activator bar 104 is shown coupled to the ejector spring 108 on one side of the activator bar 104 and the circuit board 118 on an opposite side of the activator bar 104. Two ramps 306 are further shown in the housing 102.

In the example linear edge connector 300 of FIG. 3, the contacts 118 are positioned above the circuit board 118. The pads 120 have been placed into position without the use of any lead-in features on the contacts 114. As shown in FIG. 3, the contacts 114 do not have any lead-ins that could be used to mechanically guide the circuit board 118. The contacts 114 can be nonsliding contacts without lead-ins. For example, the nonsliding contacts may have shorter lengths due to lack of any lead-ins. Furthermore, since the pads 120 do not travel under any pressure or friction between the contacts 114 of the housing 102 and the circuit board 118. Thus, the substrate solder mask and the gold pad surfaces of the pads 120 do not experience any wear associated with friction. In addition, with the improved contact designs, high speed signaling can be used. The removal or lack of conductive lead-ins can improve high speed signaling by reducing signal noise caused by the presence of conductive lead-ins. As also shown in FIG. 3, the contacts 114 are not yet centered above the pads 120. The activator bar 104 has not yet engaged the ramps 306, but is shown close to the edge of the ramps 306. In some examples, the ramps 306 can guide the activator bar between a closed position and an open position.

The side view of FIG. 3 is not intended to indicate that the example linear edge connector 300 is to include all of the components shown in FIG. 3. Further, the example linear edge connector 300 may include any number of additional components not shown in FIG. 3, depending on the details of the specific implementation. For example, the example LEC 300 may include additional cables, contacts, springs, among other additional components.

Figure 4:
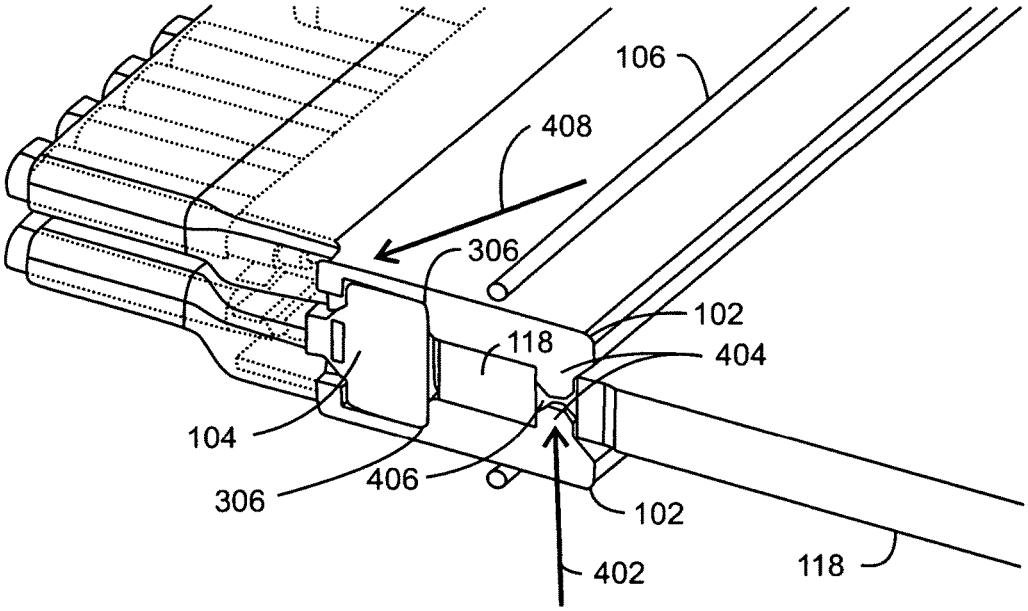
FIG. 4 is a block diagram of an example linear edge connector fully coupled to a substrate.

FIG. 4 is a block diagram of an example linear edge connector fully coupled to a circuit board. The example linear edge connector of FIG. 4 is generally referred to by the reference number 400.

The example linear edge connector 400 includes a circuit board 118 shown fully engaged with a housing 102 of the example LEC 400. An arrow 402 indicates a locking together of two features 404 the housing 102 at a notch or hole 406 of the circuit board 118. Another arrow 408 indicates the engagement of the activator bar 104 with the ramps 306 of the housing 102 and the subsequent movement of the contact load spring 106 to bring the two housing halves 102 together.

In the example of FIG. 4, the mating cycle of the circuit board 118 with the example linear edge connector 400 has completed. The internal ramps 306 control the closure of the two parts of the housing 102. For example, as the activator bar 104 engages the ramps 306, the two housing parts 102 close together due to force from the contact load spring. The contact load spring is applying force to the housing halves, and therefore the molded-in contacts. In some examples, the ramps 306 can be any profile in the housing 102 that controls the separation distance between the two connector housing halves 102. The contact load spring 106 continues to apply an appropriate contact load force between the housing parts 102 as the activator bar 104 fully engages the ramps 306. As can be seen in FIG. 4, the circuit board 118 can have a greater thickness than the circuit board 118 shown and can still be engaged without any problems. Moreover, because the contacts of the housing (not shown) approached the pads (not shown) of the circuit board 118 in a nearly vertical manner as discussed above in FIG. 3, any abrasion and corresponding gold removal from the pads of the circuit board pads is eliminated.

In some examples, as shown in FIG. 4, the circuit board 118 may have one or more notch or hole features 406 that can engage the housing 102 when the two parts of the housing 102 meet. The resulting coupling of the circuit board 118 and the housing 102 can stabilize the LEC 400 and reduce fretting. In some examples, the circuit board can communicate with the system via high speed signaling. For example, a high speed signaling can be at the speed of 10 Gigabits per second (Gbps) or above.

The cross section of FIG. 4 is not intended to indicate that the example linear edge connector 400 is to include all of the components shown in FIG. 4. Further, the example linear edge connector 400 may include any number of additional components not shown in FIG. 4, depending on the details of the specific implementation. For example, the example LEC 400 may include additional cables, contacts, springs, among other additional components.

Figure 5:
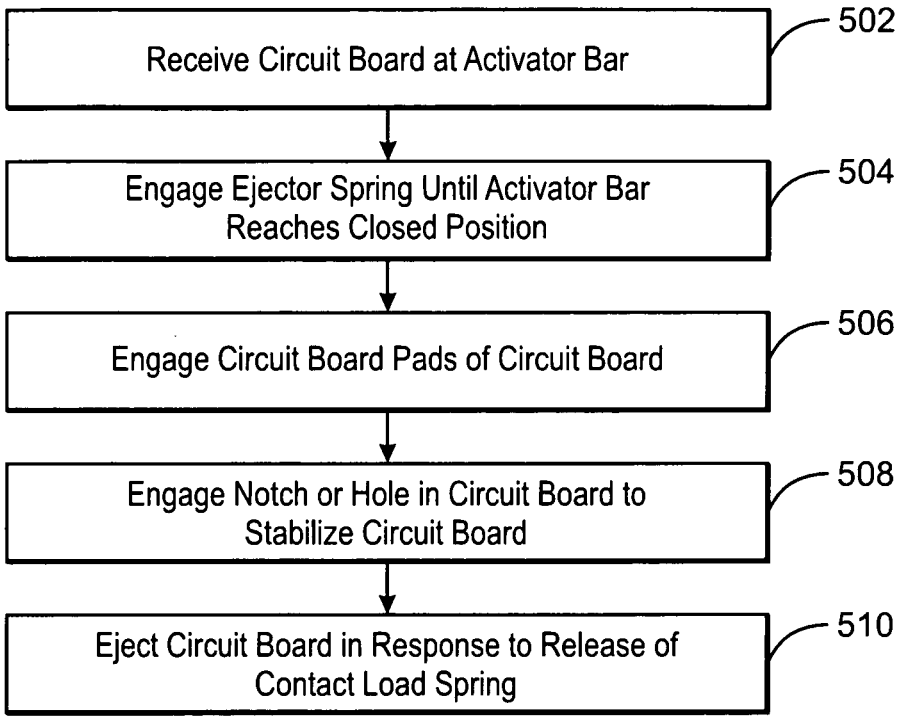
FIG. 5 is a block flow diagram of method for connecting circuit.

FIG. 5 is a block flow diagram of an example method for connecting circuit boards. The example method is generally referred to by the reference number 500. The method can be implemented using the example LEC 100-400 of FIGS. 1-4 above. The method can also be implemented in the example system 600 of FIG. 6 below.

At block 502, an activator bar receives a circuit board. In some examples, the activator bar can guide the circuit board into a position for insertion. For example, the activator bar can include a recess to receive the circuit board. In some examples, the housing of the LEC can also include a recess on the contact housings to guide the circuit board into position for insertion.

At block 504, the activator bar engages an ejector spring until activator bar reaches closed position. In some examples, the circuit board can be inserted into the housing without any contact between the contacts of the housing and the pads of the circuit board until the activator bar reaches the closed position. For example, the activator bar may have engaged one or more ramps. In some examples, the activator bar may be held in place via friction with the one more ramps. For example, the friction produced by the force from the contact load spring at the ramps may be larger than the force from the ejector spring.

At block 506, contacts of a housing engage circuit board pads of a circuit board. For example, the activator bar can engage one or more ramps and cause the contacts of the housing to engage the circuit board pads. In some examples, the contacts of the housing engage the circuit board pads at a perpendicular angle to the force from the circuit board. In some examples, ground contacts of the contacts can be engaged before signal contacts of the contacts to prevent damage from electrostatic discharge (ESD). In some examples, the housing can provide a tactile indication of a proper mating in response to the activator bar reaching the closed position. For example, the tactile indication can be via a snapping of the activator bar into the housing in response to the activator bar reaching the closed position.

At block 508, the housing engages a notch or hole in the circuit board to stabilize the circuit board. For example, the two features of the housing can be brought together by the contact load spring to engage the notch or hole. In some examples, the engaged notch or hole can reduce fretting and abrasion of the contacts by reducing movement between the housing and the circuit board.

At block 510, the ejector spring ejects the circuit board in response to a release of the contact load spring. In some examples, ejection features can reduce effort to eject the circuit board and any potential damage to the LEC, the processor, and surrounding system components of a system.

This process flow diagram is not intended to indicate that the blocks of the example method 500 are to be executed in any particular order, or that all of the blocks are to be included in every case. Further, any number of additional blocks not shown may be included within the example method 500, depending on the details of the specific implementation.

Figure 6:
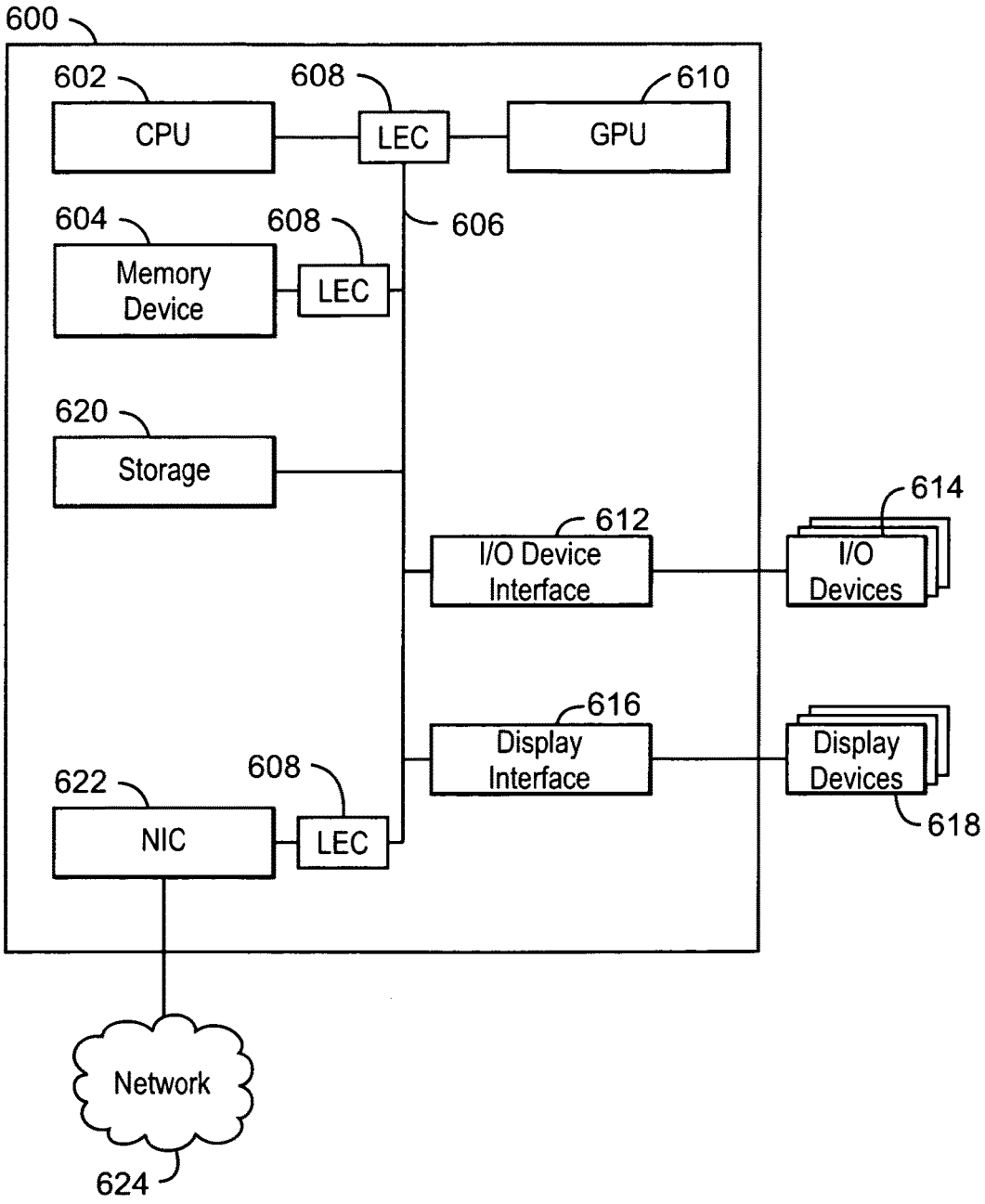
FIG. 6 is a block flow diagram of an example system that can receive circuit boards.

FIG. 6 is a block diagram illustrating an example computing device that can receive circuit boards. The computing device 600 may be, for example, a laptop computer, desktop computer, or server, among others. The computing device 600 may include a central processing unit (CPU) 602 that is configured to execute stored instructions, as well as a memory device 604 that stores instructions that are executable by the CPU 602. The CPU 602 and the memory device may be coupled to a bus 606 via a linear edge connector 608. For example, the linear edge connector 608 can be the linear edge connector 100 of FIG. 1 above. The CPU 602 and the memory device 604 can be coupled together via the bus 606. Additionally, the CPU 602 can be a single core processor, a multi-core processor, a computing cluster, or any number of other configurations. Furthermore, the computing device 600 may include more than one CPU 602. The memory device 604 can include random access memory (RAM), read only memory (ROM), flash memory, or any other suitable memory systems. For example, the memory device 604 may include dynamic random access memory (DRAM).

The computing device 600 may also include a graphics processing unit (GPU) 610. As shown, the CPU 602 may be coupled through the bus 606 to the GPU 610. The GPU 610 may be configured to perform any number of graphics operations within the computing device 600. For example, the GPU 610 may be configured to render or manipulate graphics images, graphics frames, videos, or the like, to be displayed to a user of the computing device 600.

The memory device 604 can include random access memory (RAM), read only memory (ROM), flash memory, or any other suitable memory systems. For example, the memory device 604 may include dynamic random access memory (DRAM).

The CPU 602 may also be connected through the bus 606 to an input/output (I/O) device interface 612 configured to connect the computing device 600 to one or more I/O devices 614. Although not shown in the example FIG. 6, in some examples the I/O device interface 612 may also be connected to the bus 606 via an LEC 608. The I/O devices 614 may include, for example, a keyboard and a pointing device, wherein the pointing device may include a touchpad or a touchscreen, among others. The I/O devices 614 may be built-in components of the computing device 600, or may be devices that are externally connected to the computing device 600. In some examples, the memory 604 may be communicatively coupled to I/O devices 614 through direct memory access (DMA).

The CPU 602 may also be linked through the bus 606 to a display interface 616 configured to connect the computing device 600 to a display device 618. The display device 618 may include a display screen that is a built-in component of the computing device 600. The display device 618 may also include a computer monitor, television, or projector, among others, that is internal to or externally connected to the computing device 600. In some examples, the display interface 616 may be connected to the bus via an LEC 608.

The computing device also includes a storage device 620. The storage device 620 is a physical memory such as a hard drive, an optical drive, a thumbdrive, an array of drives, or any combinations thereof. The storage device 620 may also include remote storage drives.

The computing device 600 may also include a network interface controller (NIC) 622. The NIC 622 may be configured to connect the computing device 600 through the bus 606 and an LEC 608 to a network 624. The network 624 may be a wide area network (WAN), local area network (LAN), or the Internet, among others. In some examples, the device may communicate with other devices through a wireless technology. For example, Bluetooth® or similar technology may be used to connect with other devices.

The block diagram of FIG. 6 is not intended to indicate that the computing device 600 is to include all of the components shown in FIG. 6. Rather, the computing system 600 can include fewer or additional components not illustrated in FIG. 6, such as sensors, power management integrated circuits, additional network interfaces, additional LECs, and the like. The computing device 600 may include any number of additional components not shown in FIG. 6, depending on the details of the specific implementation.

An embodiment is an implementation or example. Reference in the specification to "an embodiment", "one embodiment", "some embodiments", "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

EXAMPLES

Example 1 is an apparatus for connecting linear edge cards. The apparatus includes a housing to hold at least one set of conductive contacts facing perpendicularly towards a mating plane. The apparatus also includes an activator bar coupled to the housing, the activator bar to hold two parts of the housing apart via two opposing normal forces. The apparatus also includes a contact load spring coupled to the housing. The contact load spring is to apply two forces parallel to the direction of the conductive contacts and against the two opposing normal forces of the activator bar. The apparatus includes an ejector spring coupled to the contact load spring and the activator bar. The ejector spring is to apply a force perpendicular to the two opposing normal forces of the activator bar and in a direction of an opening of the housing.

Example 2 includes the apparatus of example 1, including or excluding optional features. In this example, the activator bar further includes a recess parallel to the mating plane to receive the circuit board and guide the circuit board into a position for insertion.

Example 3 includes the apparatus of any one of examples 1 to 2, including or excluding optional features. In this example, the housing further includes two ramps. The two ramps are to guide the activator bar between a closed position and an open position.

Example 4 includes the apparatus of any one of examples 1 to 3, including or excluding optional features. In this example, the apparatus includes a plurality of cables electrically coupled to the conductive contacts of the housing.

Example 5 includes the apparatus of any one of examples 1 to 4, including or excluding optional features. In this example, the apparatus includes at least one ground bar coupled to the housing to provide grounding for the conductive contacts.

Example 6 includes the apparatus of any one of examples 1 to 5, including or excluding optional features. In this example, the housing includes two sets of conductive contacts facing perpendicular to the mating plane and in opposing directions towards the mating plane.

Example 7 includes the apparatus of any one of examples 1 to 6, including or excluding optional features. In this example, the apparatus includes an over-molding coupled to the housing to protect the apparatus from contamination.

Example 8 includes the apparatus of any one of examples 1 to 7, including or excluding optional features. In this example, the activator bar includes a cam.

Example 9 includes the apparatus of any one of examples 1 to 8, including or excluding optional features. In this example, the conductive contacts are nonsliding contacts.

Example 10 includes the apparatus of any one of examples 1 to 9, including or excluding optional features. In this example, the conductive contacts are high-speed signaling contacts.

Example 11 is a method for connecting circuit boards. The method includes receiving a circuit board at an activator bar; engaging, via a force from the circuit board, an ejector spring until the activator bar reaches a closed position; and engaging, via a contact load spring force, contacts of a housing to circuit board pads of the circuit board, wherein the contacts of the housing engage the circuit board pads at a perpendicular angle to the force from the circuit board.

Example 12 includes the method of example 11, including or excluding optional features. In this example, the method includes engaging, via the contact load spring force, the housing with a notch or a hole in the circuit board to stabilize the circuit board.

Example 13 includes the method of any one of examples 11 to 12, including or excluding optional features. In this example, the method includes providing a tactile indication of a proper mating via a snapping of the activator bar into the housing in response to the activator bar reaching the closed position.

Example 14 includes the method of any one of examples 11 to 13, including or excluding optional features. In this example, the method includes guiding the circuit board into a position for insertion via a recess on the contact housings.

Example 15 includes the method of any one of examples 11 to 14, including or excluding optional features. In this example, the circuit board is inserted into the housing without any contact between the contacts of the housing and the circuit board pads until the activator bar reaches the closed position.

Example 16 includes the method of any one of examples 11 to 15, including or excluding optional features. In this example, the method includes ejecting the circuit board via the ejector spring in response to a release of the contact load spring.

Example 17 includes the method of any one of examples 11 to 16, including or excluding optional features. In this example, receiving a circuit board at an activator bar further includes receiving the circuit board at a recess in the activator bar.

Example 18 includes the method of any one of examples 11 to 17, including or excluding optional features. In this example, engaging the contacts of a housing to circuit board pads of the circuit board further includes engaging the activator bar with at least one ramp.

Example 19 includes the method of any one of examples 11 to 18, including or excluding optional features. In this example, the closed position includes an engaging of the activator bar with a ramp.

Example 20 includes the method of any one of examples 11 to 19, including or excluding optional features. In this example, engaging contacts of a housing to circuit board pads of the circuit board further includes engaging ground contacts of the contacts before signal contacts of the contacts to prevent damage from electrostatic discharge (ESD).

Example 21 is a system for connecting linear edge cards. The system includes a linear edge card connector including a housing to hold at least one set of conductive contacts facing perpendicularly towards a mating plane. The linear edge card connector also includes an activator bar coupled to the housing. The activator bar is to hold two parts of the housing apart via two opposing normal forces. The linear edge card connector also includes a contact load spring coupled to the housing. The contact load spring is to apply two forces parallel to the direction of the conductive contacts and against the two opposing normal forces of the activator bar. The linear edge card connector also includes an ejector spring coupled to the contact load spring and the activator bar. The ejector spring is to apply a force perpendicular to the two opposing normal forces of the activator bar and in the direction of an opening of the housing. The system also includes a circuit board to be coupled to the linear edge card connector via the at least one set of conductive contacts and the activator bar.

Example 22 includes the system of example 21, including or excluding optional features. In this example, the circuit board is to be further coupled to the housing via coupling between the housing and a notch or a hole in the circuit board.

Example 23 includes the system of any one of examples 21 to 22, including or excluding optional features. In this example, the activator bar further includes a recess parallel to the mating plane to receive the circuit board and guide the circuit board into a position for insertion.

Example 24 includes the system of any one of examples 21 to 23, including or excluding optional features. In this example, the activator bar is to receive a range of different circuit boards having different thicknesses.

Example 25 includes the system of any one of examples 21 to 24, including or excluding optional features. In this example, the housing further includes two ramps, the two ramps to guide the activator bar between a closed position and an open position.

Example 26 includes the system of any one of examples 21 to 25, including or excluding optional features. In this example, the housing includes a recess to guide the circuit board into position for insertion.

Example 27 includes the system of any one of examples 21 to 26, including or excluding optional features. In this example, the circuit board is to communicate with the system via high speed signaling.

Example 28 includes the system of any one of examples 21 to 27, including or excluding optional features. In this example, the circuit board further includes pads with reduced length.

Example 29 includes the system of any one of examples 21 to 28, including or excluding optional features. In this example, the circuit board includes a peripheral card.

Example 30 includes the system of any one of examples 21 to 29, including or excluding optional features. In this example, the circuit board includes a processor.

Example 31 is an apparatus for connecting linear edge cards. The apparatus includes means for holding at least one set of conductive contacts facing perpendicularly towards a mating plane. The apparatus includes means for holding two parts of the housing apart via two opposing normal forces. The apparatus includes means for applying two forces parallel to the direction of the conductive contacts and against the two opposing normal forces of the activator bar. The apparatus includes means for applying a force perpendicular to the two opposing normal forces of the activator bar and in a direction of an opening of the housing.

Example 32 includes the apparatus of example 31, including or excluding optional features. In this example, the means for holding two parts of the housing apart include a recess parallel to the mating, plane to receive the circuit board and guide the circuit board into a position for insertion.

Example 33 includes the apparatus of any one of examples 31 to 32, including or excluding optional features. In this example, the means for holding at least one set of conductive contacts further include means for guiding the activator bar between a closed position and an open position.

Example 34 includes the apparatus of any one of examples 31 to 33, including or excluding optional features. In this example, the apparatus includes means for electrically coupling the conductive contacts of the housing.

Example 35 includes the apparatus of any one of examples 31 to 34, including or excluding optional features. In this example, the apparatus includes means for providing grounding for ground contacts in the conductive contacts.

Example 36 includes the apparatus of any one of examples 31 to 35, including or excluding optional features. In this example, the means for holding at least one set of conductive contacts include two sets of conductive contacts facing perpendicular to the mating plane and in opposing directions towards the mating plane.

Example 37 includes the apparatus of any one of examples 31 to 36, including or excluding optional features. In this example, the apparatus includes means for protecting the apparatus from contamination.

Example 38 includes the apparatus of any one of examples 31 to 37, including or excluding optional features. In this example, the means for holding two parts of the housing apart include a cam.

Example 39 includes the apparatus of any one of examples 31 to 38, including or excluding optional features. In this example, the conductive contacts include nonsliding contacts.

Example 40 includes the apparatus of any one of examples 31 to 39, including or excluding optional features. In this example, the conductive contacts include high-speed signaling contacts.

It is to be understood that specifics in the aforementioned examples may be used anywhere in one or more embodiments. For instance, all optional features of the computing device described above may also be implemented with respect to either of the methods described herein or a computer-readable medium. Furthermore, although flow diagrams and/or state diagrams may have been used herein to describe embodiments, the present techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus for connecting linear edge cards, comprising:

a housing to hold at least one set of conductive contacts facing perpendicularly towards a mating plane;

an activator bar coupled to the housing, the activator bar to hold two parts of the housing apart via two opposing normal forces;

a contact load spring coupled to the housing, the contact load spring to apply two forces parallel to the direction of the conductive contacts and against the two opposing normal forces of the activator bar; and an ejector spring coupled to the contact load spring and the activator bar, the ejector spring to apply a force perpendicular to the two opposing normal forces of the activator bar and in a direction of an opening of the housing.

2. The apparatus of claim 1, wherein the activator bar further comprises a recess parallel to the mating plane to receive a circuit board and guide the circuit board into a position for insertion.

3. The apparatus of claim 1, wherein the housing further comprises two ramps, the two ramps to guide the activator bar between a closed position and an open position.

4. The apparatus of claim 1, further comprising a plurality of cables electrically coupled to the conductive contacts of the housing.

5. The apparatus of claim 1, further comprising at least one ground bar coupled to the housing to provide grounding for the conductive contacts.

6. The apparatus of claim 1, wherein the housing comprises two sets of conductive contacts facing perpendicular to the mating plane and in opposing directions towards the mating plane.

7. The apparatus of claim 1, further comprising an overmolding coupled to the housing to protect the apparatus from contamination.

8. A method for connecting circuit boards, comprising:

receiving a circuit board at an activator bar;

engaging, via a force from the circuit board, an ejector spring until the activator bar reaches a closed position, the ejector spring applying a force perpendicular to the two opposing normal forces of the activator bar and in a direction of an opening of a housing; and engaging, via a contact load spring force, contacts of the housing to circuit board pads of the circuit board, wherein the contacts of the housing engage the circuit board pads at a perpendicular angle to the force from the circuit board.

9. The method of claim 8, further comprising engaging, via the contact load spring force, the housing with a notch or a hole in the circuit board to stabilize the circuit board.

10. The method of claim 8, further comprising providing a tactile indication of a proper mating via a snapping of the activator bar into the housing in response to the activator bar reaching the closed position.

11. The method of claim 8, further comprising guiding the circuit board into a position for insertion.

12. The method of claim 8, wherein the circuit board is inserted into the housing without any contact between the contacts of the housing and the circuit board pads until the activator bar reaches the closed position.

13. The method of claim 8, further comprising ejecting the circuit board via the ejector spring in response to a release of the contact load spring.

14. A system for connecting linear edge cards, comprising:

a linear edge card connector comprising:

a housing to hold at least one set of conductive contacts facing perpendicularly towards a mating plane;

an activator bar coupled to the housing, the activator bar to hold two parts of the housing apart via two opposing normal forces;

a contact load spring coupled to the housing, the contact load spring to apply two forces parallel to the direction of the conductive contacts and against the two opposing normal forces of the activator bar;

an ejector spring coupled to the contact load spring and the activator bar, the ejector spring to apply a force perpendicular to the two opposing normal forces of the activator bar and in a direction of an opening of the housing; and a circuit board to be coupled to the linear edge card connector via the at least one set of conductive contacts and the activator bar.

15. The system of claim 14, wherein the circuit board is to be further coupled to the housing via coupling between the housing and a notch or a hole in the circuit board.

16. The system of claim 14, wherein the activator bar further comprises a recess parallel to the mating plane to receive the circuit board and guide the circuit board into a position for insertion.

17. The system of claim 14, wherein the housing further comprises two ramps, the two ramps to guide the activator bar between a closed position and an open position.

18. The system of claim 14, wherein the housing comprises a lead-in to guide the circuit board into position for insertion.

19. The system of claim 14, wherein the circuit board is to communicate with the system via high speed signaling.

* * * * *